US008577252B2

(12) United States Patent
Anan et al.

(10) Patent No.: US 8,577,252 B2
(45) Date of Patent: Nov. 5, 2013

(54) PROCESS CARTRIDGE AND DISASSEMBLING METHOD OF THE PROCESS CARTRIDGE

(75) Inventors: Osamu Anan, Susono (JP); Koji Yamaguchi, Namazu (JP); Kazuhiko Kanno, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 335 days.

(21) Appl. No.: 12/956,233

(22) Filed: Nov. 30, 2010

(65) Prior Publication Data

US 2011/0142487 A1 Jun. 16, 2011

(30) Foreign Application Priority Data

Dec. 11, 2009 (JP) ..... 2009-281597

(51) Int. Cl.
*G03G 15/00* (2006.01)
*G03G 21/18* (2006.01)

(52) U.S. Cl.
USPC ..... 399/109; 399/113

(58) Field of Classification Search
USPC ..... 399/109, 113, 111
See application file for complete search history.

(56) References Cited

U.S. PATENT DOCUMENTS

| | | | |
|---|---|---|---|
| 5,729,796 | A | 3/1998 | Miura et al. |
| 5,768,658 | A | 6/1998 | Watanabe et al. |
| 5,815,644 | A | 9/1998 | Nishiuwatoko et al. |
| 5,870,655 | A | 2/1999 | Nishiuwatoko et al. |
| 5,893,006 | A | 4/1999 | Kanno et al. |
| 5,926,666 | A | 7/1999 | Miura et al. |
| 5,937,240 | A | 8/1999 | Kanno et al. |
| 5,940,657 | A | 8/1999 | Yokomori et al. |
| 5,950,049 | A | 9/1999 | Yokomori et al. |
| 6,070,029 | A | 5/2000 | Nishiuwatoko et al. |
| 6,072,969 | A | 6/2000 | Yokomori et al. |
| 6,327,448 | B1 | 12/2001 | Sasaki |
| 6,345,164 | B1 | 2/2002 | Yokomori et al. |

(Continued)

FOREIGN PATENT DOCUMENTS

| | | |
|---|---|---|
| CN | 101479674 | 7/2009 |
| JP | 2001-42753 | 2/2001 |
| JP | 2002-14592 | 1/2002 |

OTHER PUBLICATIONS

May 25, 2012 Office Action in Chinese Patent Appliation No. 201010582103.5 (with English translation).

*Primary Examiner* — David Gray
*Assistant Examiner* — Gregory H Curran
(74) *Attorney, Agent, or Firm* — Fitzpatrick, Cella, Harper & Scinto

(57) ABSTRACT

A process cartridge detachably mountable to a main assembly of an image forming apparatus includes an image-bearing member on which an electrostatic image is to be formed; a first frame; a bearing member, detachably mountable to the first frame, for rotatably supporting the image-bearing member; a first hole provided in the bearing member; a first wall, provided on the first frame, in which a second hole is provided; a second frame for rotatably supporting a developer carrying member on which a developer for developing the electrostatic image is to be carried; a second wall, provided on the second frame, in which a third hole is provided; and a connecting member including a shaft portion penetrating through the first hole, the second hole and the third hole and tightly engaging in the second hole, and including a flange portion, provided at an end portion of the shaft portion, for preventing the bearing member from being detached from the first frame.

6 Claims, 6 Drawing Sheets

(56) References Cited

U.S. PATENT DOCUMENTS

| | | | | |
|---|---|---|---|---|
| 6,381,430 | B1 | 4/2002 | Yokomori et al. | |
| 6,496,667 | B2 | 12/2002 | Shiratori et al. | |
| 6,516,168 | B2 | 2/2003 | Shiratori et al. | |
| 6,560,422 | B2 | 5/2003 | Kanno et al. | |
| 6,643,482 | B2 | 11/2003 | Higeta et al. | |
| 6,681,088 | B2 | 1/2004 | Kanno et al. | |
| 6,735,403 | B2 | 5/2004 | Kanno et al. | |
| 6,782,219 | B2 | 8/2004 | Yoshino et al. | |
| 6,834,173 | B2 | 12/2004 | Yamaguchi et al. | |
| 6,915,092 | B2 | 7/2005 | Yamaguchi et al. | |
| 6,937,834 | B2 | 8/2005 | Kanno et al. | |
| 6,947,687 | B2 | 9/2005 | Yamaguchi et al. | |
| 6,961,528 | B2 | 11/2005 | Yamaguchi et al. | |
| 6,980,759 | B2 | 12/2005 | Kanno et al. | |
| 6,983,115 | B2 | 1/2006 | Isobe et al. | |
| 7,058,337 | B2 | 6/2006 | Hashimoto et al. | |
| 7,068,965 | B2 | 6/2006 | Yoshino et al. | |
| 7,099,607 | B2 | 8/2006 | Suzuki et al. | |
| 7,116,925 | B2 | 10/2006 | Yamaguchi | |
| 7,136,604 | B2 | 11/2006 | Chadani et al. | |
| 7,184,686 | B2 | 2/2007 | Kanno et al. | |
| 7,184,687 | B2 | 2/2007 | Yamaguchi et al. | |
| 7,194,225 | B2 | 3/2007 | Yamaguchi | |
| 7,319,834 | B2 | 1/2008 | Yamaguchi | |
| 7,366,439 | B2 | 4/2008 | Anan et al. | |
| 7,366,441 | B2 * | 4/2008 | Hatori | 399/113 |
| 7,463,844 | B2 | 12/2008 | Hashimoto et al. | |
| 7,477,865 | B2 | 1/2009 | Yamaguchi | |
| 7,519,310 | B2 | 4/2009 | Yamaguchi et al. | |
| 7,720,412 | B2 | 5/2010 | Anan et al. | |
| 7,756,441 | B2 | 7/2010 | Kanno et al. | |
| 7,792,460 | B2 | 9/2010 | Yamaguchi et al. | |
| 2006/0072938 | A1 * | 4/2006 | Sato et al. | 399/113 |
| 2007/0092291 | A1 | 4/2007 | Suzuki et al. | |
| 2008/0138105 | A1 | 6/2008 | Kanno et al. | |
| 2008/0138110 | A1 | 6/2008 | Yoshino et al. | |
| 2009/0003875 | A1 * | 1/2009 | Toba et al. | 399/111 |
| 2009/0238603 | A1 | 9/2009 | Kusudo et al. | |
| 2009/0245851 | A1 | 10/2009 | Hoshi et al. | |
| 2009/0297211 | A1 | 12/2009 | Kanno et al. | |
| 2009/0297212 | A1 | 12/2009 | Anan et al. | |
| 2009/0297219 | A1 | 12/2009 | Yoshino et al. | |
| 2010/0158565 | A1 | 6/2010 | Kanno et al. | |
| 2010/0290806 | A1 | 11/2010 | Yamaguchi et al. | |

* cited by examiner

PROCESS CARTRIDGE AND DISASSEMBLING METHOD OF THE PROCESS CARTRIDGE

FIELD OF THE INVENTION AND RELATED ART

The present invention relates to a process cartridge detachably mountable to a main assembly of an electrophotographic image forming apparatus such as an electrophotographic copying machine or an electrophotographic printer.

Here, the electrophotographic image forming apparatus forms an image on a recording sheet by using an electrophotographic image forming method and, e.g., includes the electrophotographic copying machine, the electrophotographic printer (such as a laser beam printer or an LED printer), a facsimile machine, a word processor, and the like.

Further, the process cartridge is prepared by integrally assembling an electrophotographic photosensitive drum at least one of a charging means, a developing means and a cleaning means into a cartridge, which is detachably mountable to the main assembly of the image forming apparatus.

In a conventional image forming apparatus using an electrophotographic image forming process, the process cartridge prepared by integrally assembling the electrophotographic photosensitive drum and a process means acting on the electrophotographic photosensitive drum into a cartridge is present. A process cartridge type in which this process cartridge is detachably mountable to the main assembly of the electrophotographic image forming apparatus has been widely employed.

According to this process cartridge type, maintenance of the electrophotographic image forming apparatus can be performed by a user himself (herself) without relying on a service person, so that operativity is considerably improved.

Further, e.g., some process cartridges include a cleaning unit (first frame) for holding the electrophotographic photosensitive drum and a developing unit (second frame) for holding the developing means for developing an electrophotographic, formed on the electrophotographic photosensitive drum, with toner (developer). These first and second frames are rotatably connected to each other by a round bar-like connecting pin.

Incidentally, the electrophotographic image forming apparatus forms the image on the sheet with the toner. When the image formation on the sheet is repeated, in the process cartridge including the developing means, the toner accommodated in a developer accommodating portion is gradually consumed. Then, at some feature time, the developer is consumed to the extent that the image of satisfactory quality to the user cannot be formed, so that a commercial value as the process cartridge is lost. With respect to disassembling, cleaning and reuse (recycle) by collecting the spent process cartridge as described above, an invention described in Japanese Patent No. 3320403 is disclosed as n example of a method therefore, and an invention described in Japanese Laid-Open Patent Application (JP-A) 2001-42753 is disclosed as an example of a constitution thereof.

The invention described in Japanese Patent No. 3320403 relates to a disassembling method of a process cartridge in which a first frame for supporting the electrophotographic photosensitive drum and a second frame for supporting a developing roller are rotatably and movably connected to each other and in which a separation step of separating the first frame and the second frame is included. According to this method, the spend process cartridge is collected and then can be disassembled, cleaned and reused.

Further, the invention described in JP-A 2001-42753 relates to the constitution of a process cartridge in which the first frame for supporting the electrophotographic photosensitive drum and the second frame for supporting the developing roller are rotatably and movably connected to each other by a connecting pin. Further, in this process cartridge, when the connecting pin for connecting the first frame and the second frame is pulled out, the first frame and the second developing roller are configured to be separated. Particularly, the connecting pin is configured to be liable to be easily pulled out. According to this constitution, when a specialized tool is used, the spent process cartridge can be easily disassembled.

However, as described in the above-mentioned documents, a technique for separating the first frame and the second developing roller from each other was merely present in the conventional art and there was no constitution and method in which other members (to be assembled into the first frame or the second frame) were separated simultaneously. Therefore, such other members have no choice but to be individually separated.

SUMMARY OF THE INVENTION

In view of the above circumstances, a principal object of the present invention is to provide a process cartridge capable of separating other members assembled to a first frame and a second frame at the same time during separation of the first frame and the second developing roller and is to provide a disassembling method of the process cartridge.

According to an aspect of the present invention, there is provided a process cartridge detachably mountable to a main assembly of an image forming apparatus, the process cartridge comprising:

an image-bearing member on which an electrostatic image is to be formed;

a first frame;

a bearing member, detachably mountable to the first frame, for rotatably supporting the image-bearing member;

a first hole provided in the bearing member;

a first wall, provided on the first frame, in which a second hole is provided;

a second frame for rotatably supporting a developer carrying member on which a developer for developing the electrostatic image is to be carried;

a second wall, provided on the second frame, in which a third hole is provided; and a connecting member including a shaft portion penetrating through the first hole, the second hole and the third hole and tightly engaging in the second hole, and including a flange portion, provided at an end portion of the shaft portion, for preventing the bearing member from being detached from the first frame.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, preferred embodiments of the present invention will be described specifically in an exemplary manner with reference to the drawings. However, dimensions, materials, shapes, relative positions of constituent elements described in the following embodiments are appropriately changed depending on constitutions and various conditions of devices (apparatuses) to which the present invention is applied and therefore the scope of the present invention is not limited to those described in the following embodiments, unless otherwise specified.

Embodiment 1

Figure 1:
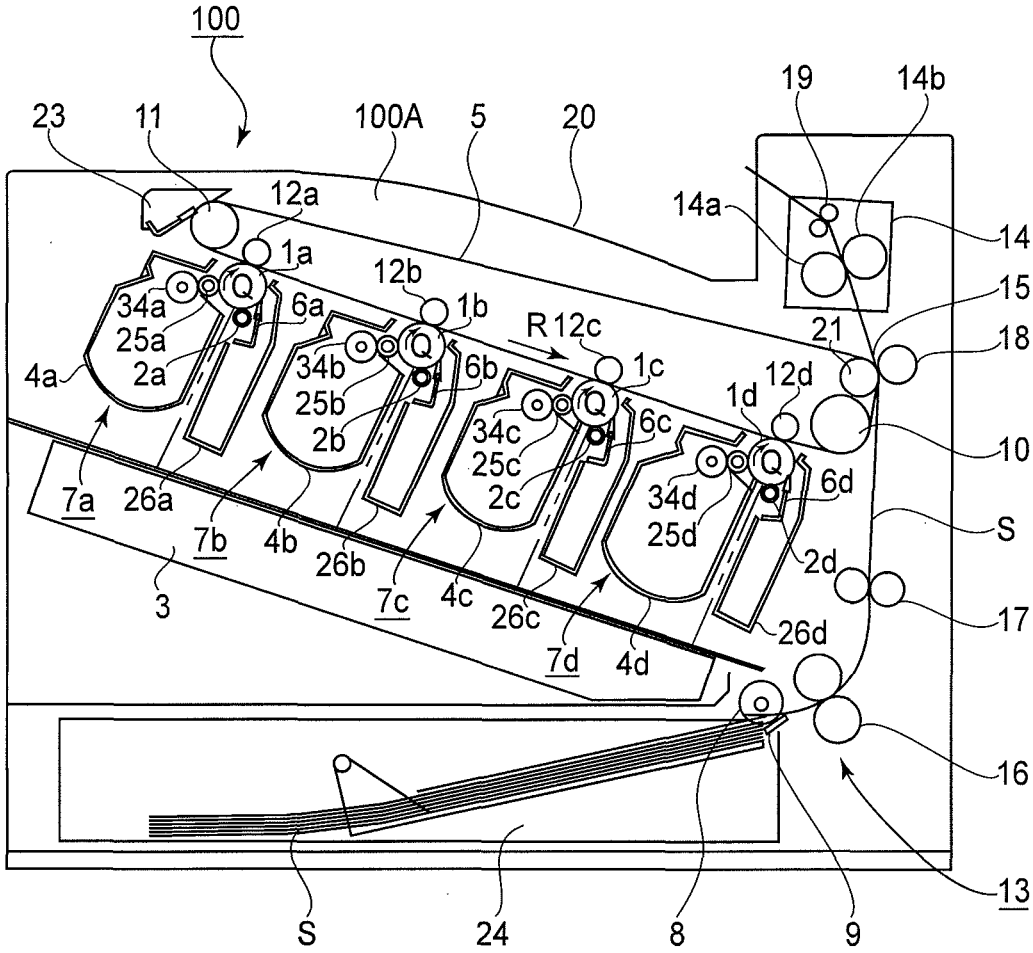
FIG. 1 is a sectional view showing a structure of an image forming apparatus in Embodiment 1 of the present invention.

FIG. 1 is a sectional view showing a structure of an image forming apparatus 100 in Embodiment 1 of the present invention. The image forming apparatus 100 utilizes an electrophotographic image forming process. As shown in FIG. 1, the image forming apparatus 100 includes an image forming apparatus main assembly 100A (hereinafter referred to as an apparatus main assembly). Inside the apparatus main assembly 100A, an image forming portion for forming an image is provided. The image forming portion includes photosensitive drums 1*a*, 1*b*, 1*c* and 1*d* which are an "image bearing member" and an "electrophotographic photosensitive drum" and includes primary transfer rollers 12*a*, 12*b*, 12*c* and 12*d*, and the like. At least the photosensitive drums 1*a*, 1*b*, 1*c* and 1*d* are included in process cartridges 7*a*, 7*b*, 7*c* and 7*d*, respectively, and the process cartridges 7*a*, 7*b*, 7*c* and 7*d* are assembled in a detachably mountable manner into the apparatus main assembly 100A.

The image forming apparatus 100 includes four mounting portions (not shown) which are cartridge mounting means obliquely juxtaposed with respect to a horizontal direction. The mounted process cartridges 7*a* to 7*d* include the photosensitive drums 1*a* to 1*d*, respectively. The (electrophotographic) photosensitive drums 1*a* to 1*d* are rotationally driven in the counterclockwise direction in FIG. 1 by a driving member (not shown). Around the photosensitive drums 1*a* to 1*d*, the following process means are successively disposed along the rotational direction of the photosensitive drums 1*a* to 1*d*. That is, cleaning members 6*a* to 6*d* for removing a developer (toner) remaining on the surfaces of the photosensitive drums 1*a* to 1*d* after transfer and charging rollers 2*a* to 2*d* for uniformly charging the surfaces of the photosensitive drums 1*a* to 1*d* are disposed. Further, developing units 4*a* to 4*d* for developing an electrostatic image with the toner are disposed. Further, a scanner unit 3 for forming the electrostatic image on the photosensitive drums 1*a* to 1*d* and an intermediary transfer belt 5 onto which four color toner images on the surfaces of the photosensitive drum 1*a* to 1*d* are collectively transferred are disposed. The photosensitive drums 1*a* to 1*d*, the cleaning members 6*a* to 6*d*, the charging rollers 2*a* to 2*d* and the developing units 4*a* to 4*d* are integrally assembled into cartridges color by color to constitute the process cartridges 7*a* to 7*d*, respectively. These process cartridges 7*a* to 7*d* are dismountable from and mountable into the apparatus main assembly 100A of the image forming apparatus 100 by a user.

The intermediary transfer belt 5 is stretched by a driving roller 10, a tension roller 11 and a stretching roller 21. Further, inside the intermediary transfer belt 5, the primary transfer rollers 12*a* to 12*d* are disposed opposed to the photosensitive drums 1*a* to 1*d*, respectively. Further, a transfer bias is applied to the intermediary transfer belt 5 by a bias applying means (not shown).

The toner images formed on the surfaces of the photosensitive drums 1*a* to 1*d* are successively primary-transferred onto the surface of the intermediary transfer belt 5 by rotating each of the photosensitive drums 1*a* to 1*d* in a direction indicated by an arrow Q, rotating the intermediary transfer belt 5 in a direction indicated by an arrow R, and by applying a bias of a positive polarity to the primary transfer roller 12. Then, the four color toner images are conveyed to a secondary transfer portion 15 in a state in which they are superposed on the intermediary transfer belt 5.

In synchronism with an image forming operation, a sheet S which is a recording medium is conveyed by a conveying means consisting of a sheet feeding device 13, a registration roller pair 17, and the like. The sheet feeding device 13 includes a sheet feeding (accommodating) cassette 24 for accommodating the sheets S, a sheet feeding roller 8 for feeding the sheet S, and a conveying roller pair 16 for conveying the fed sheet S. The sheet feeding cassette 24 can be pulled out in a frontward direction of the apparatus main assembly 100A. The sheets S stacked in the sheet feeding cassette 24 is pressed by the sheet feeding roller 8 and is separated one by one by a separation pad 9 (scraper separation type) and then is conveyed.

The sheet fed from the sheet feeding device 13 is conveyed to the secondary transfer portion 15 by the registration roller pair 17. At the secondary transfer portion 15, the bias of the positive polarity is applied to a secondary transfer roller 18. As a result, onto the conveyed sheet S, the four color toner images on the intermediary transfer belt 5 are secondary-transferred.

A fixing portion 14 which is a fixing means fixes the toner images formed on the sheet 5 by applying heat and pressure to the toner images. A fixing belt 14*a* has a cylindrical shape and is guided by a belt guide member (not shown) to which a heating means such as a heater is bonded. Further, the fixing belt 14*a* and a pressing roller 14*b* form a fixing nip with a predetermined press-contact force.

Then, the sheet S which is conveyed from the image forming portion and on which unfixed toner images are formed is heated and pressed in the fixing nip between the fixing belt 14*a* and the pressing roller 14*b*. Thus, the unfixed toner images on the sheet S are fixed on the sheet S. Thereafter, the sheet S on which the toner images are fixed is discharged onto a sheet discharging tray 20 by a sheet discharging roller pair 19.

Further, the toner remaining on the intermediary transfer belt 5 after the secondary transfer of the toner images onto the sheet S is removed by a transfer belt cleaning device 23. The removed toner passes through a residual toner conveying path (not shown) and is collected in a residual toner collecting container (not shown) disposed at a rear surface portion of the image forming apparatus.

Figure 2:
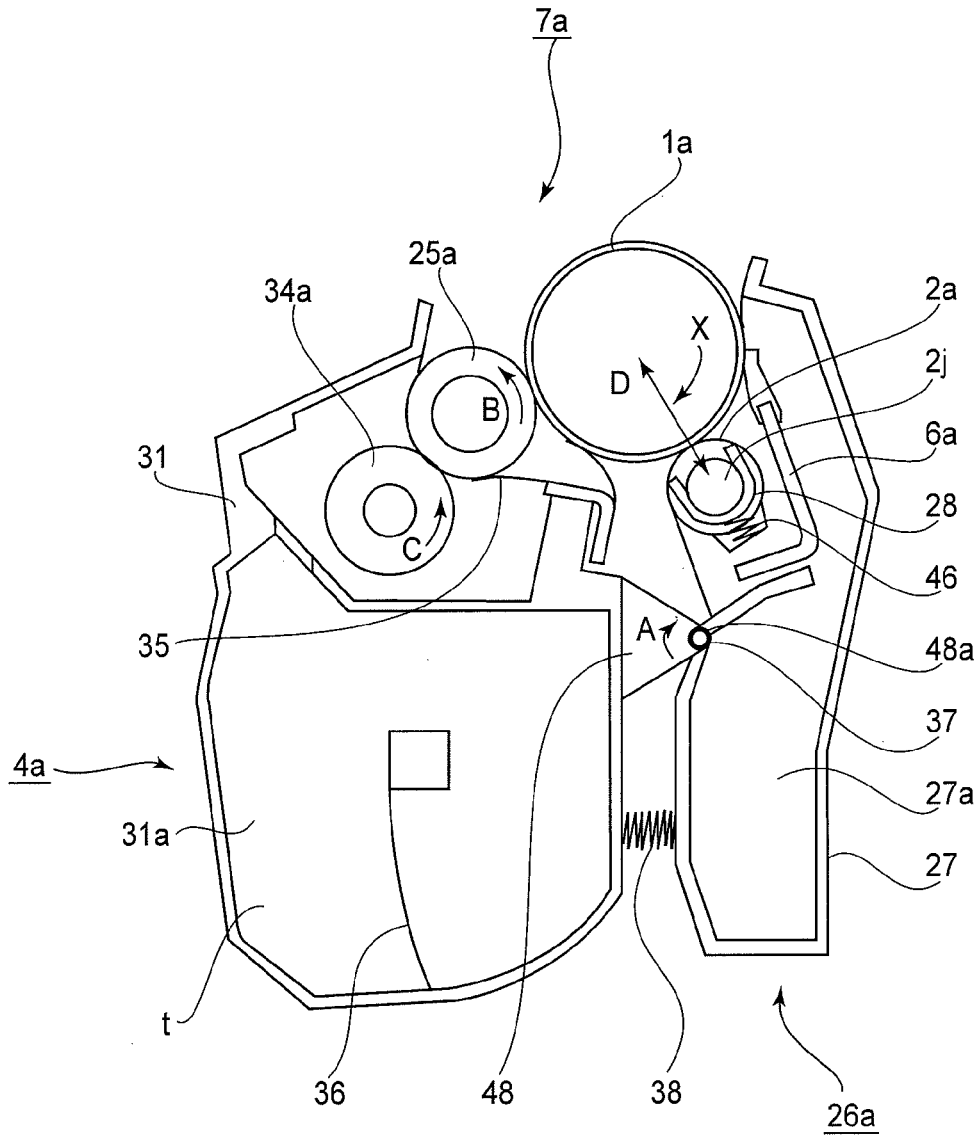
FIG. 2 is a sectional view showing a structure of a process cartridge.

FIG. 2 is a sectional view showing a structure of the process cartridge 7*a*. Each of the process cartridges 7*a* to 7*d* contains toner t. The process cartridge 7*a* containing yellow toner t, the process cartridge 7*b* containing magenta toner t, the process cartridge 7*c* containing cyan toner t and the process cartridge 7*d* containing black toner have the same constitution. For that reason, only the constitution of the process cartridge 7*a* will be described, and the description may also be quoted as that for the constitutions of the process cartridges 7*b*, 7*c* and 7*d*.

The process cartridge 7*a* is divided into a cleaning unit 26*a* including the photosensitive drum 1*a*, the charging roller 2*a* which is charging means, and the cleaning member 6*a* which is a cleaning means, and the developing unit 4*a* including a developing roller 25*a* which is a developing means.

The cleaning unit 26*a* includes a cleaning frame 27 (first frame). To the cleaning frame 27, the photosensitive drum 1*a* is rotatably attached through drum bearings 29 and 59 (FIG. 3(*a*)) described later. Further, a driving force of a driving motor (not shown) is transmitted to the cleaning unit 26*a*, so that the photosensitive drum 1*a* is rotationally driven in accordance with the image forming operation. On the peripheral surface of the photosensitive drum 1*a*, as described above, the charging roller 2*a* and the cleaning member 6*a* are disposed. The residual toner removed from the surface of the photosensitive drum 1*a* by the cleaning member 6*a* drops into a removed toner container 27*a*. To the cleaning frame 27, a charging roller bearing 28 is attached movably in a direction indicated by an arrow D passing through the center of the charging roller 2*a* and the center of the photosensitive drum 1*a*. A shaft (axis) 2*j* of the charging roller 2*a* is rotatably attached to the charging roller bearing 28. Further, the charging roller bearing 28 is pressed toward the photosensitive drum 1*a* by a charging roller pressing member 46.

The developing unit 4*a* includes the developing roller 25*a* rotating in a direction indicated by an arrow B in contact with the photosensitive drum 1*a* and includes a developing device frame 31. The developing device frame 31 which is a second frame supports the developing roller 25*a* which is a developer carrying member for carrying the electrophotographic formed on the surface of the photosensitive drum 1*a*. The developing roller 25*a* is rotatably supported by the developing device frame 31. Further, on the peripheral surface of the developing roller 25*a*, a toner feeding roller 34*a* rotating in a direction indicated by an arrow C in contact with the developing roller 25*a* and a developing blade 35 for regulating a toner layer on the developing roller 25*a* are disposed. Further, in a toner accommodating portion 31*a* of the developing device frame 31, a toner feeding (conveying) member 36 for stirring the accommodated toner and feeding the toner to the toner feeding roller 34 is provided.

Further, the developing unit 4*a* and the cleaning unit 26*a* are swingably connected by a connecting pin 37, described later, which is a connecting member. The developing unit 4*a* is urged by an urging (pressing) spring 38. For that reason, during the image formation by the process cartridge 7*a*, the developing unit 4*a* is rotated about the connecting pin 37 in a direction indicated by an arrow A< so that the developing roller 25*a* contacts the photosensitive drum 1*a*.

Figure 3:
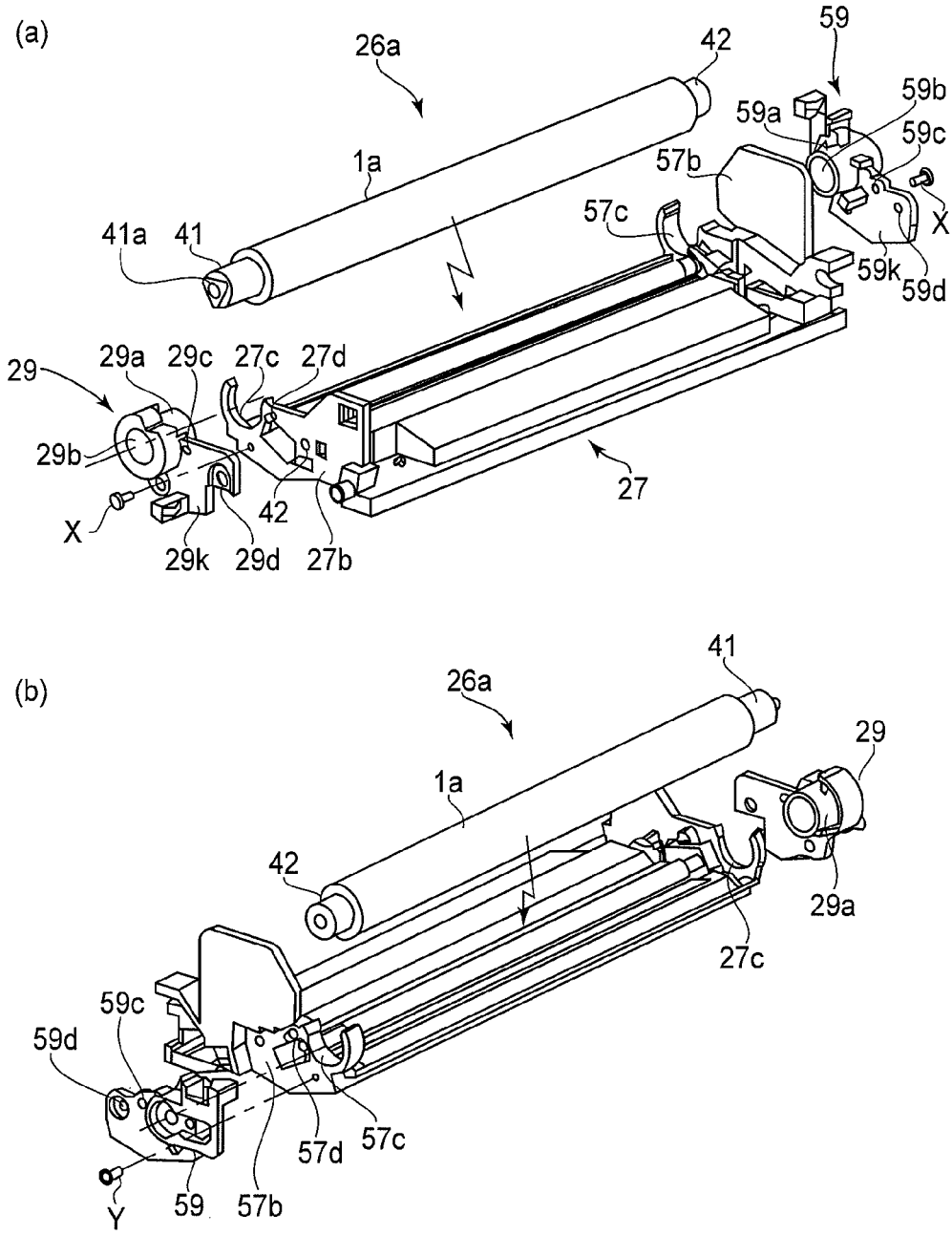
FIGS. 3(*a*) and 3(*b*) are exploded perspective views of the process cartridge as seen from a driving side of a cleaning unit and a non-driving side of the cleaning unit, respectively.

FIG. 3(*a*) is a perspective view of the cleaning unit 26*a* which is disassembled and as seen from a driving side of the cleaning unit 26*a*. FIG. 3(*b*) is a perspective view of the cleaning unit 26*a* which is disassembled and as seen from a non-driving side of the cleaning unit 26*a*. With reference to these FIGS. 3(*a*) and 3(*b*), the constitution in which the photosensitive drum 1*a* and the drum bearings 29 and 59 which constitute the cleaning unit 26*a* are assembled to the cleaning frame 27 will be described in detail.

The photosensitive drum 1*a* is provided with a drum flange 41 at one end portion thereof and is provided with a drum flange 42 at the other end portion thereof. At an end surface of the drum flange 41 on the driving side of the cleaning unit 26*a*, a projected portion 41*a* which is a cartridge-side coupling means is formed.

The drum bearing 29 which is a bearing member includes an inner peripheral portion 29*b* which is a bearing hole in which the photosensitive drum 1*a* is rotatably supported and includes a through-hole 29*d* which is a first pin hole (first hole portion). The drum bearing 29 will be described more specifically. The drum bearing 29 includes an outer peripheral projected portion 29*b* projected toward the cleaning frame 27 and includes a plate portion 29*k*. The drum bearing 29 includes the inner peripheral portion 29*b* which penetrates through the outer peripheral projected portion 29*a* in an axial direction of the photosensitive drum 1*a*. Further, the drum bearing 29 includes a positioning hole 29*c*, provided in the plate portion 29*k*, for positioning the drum bearing 29 relative to the cleaning frame 27. Further, the drum bearing 29 includes the through-hole 29*d*, provided in the plate portion 29*k*, into which the connecting pin 37 described later is inserted.

Similarly, the drum bearing 59 which is a bearing member includes an inner peripheral portion 59*b* which is the bearing hole in which the photosensitive drum 1*a* is rotatably supported and includes a through-hole 59*d* which is the first pin hole. The drum bearing 59 will be described more specifically. The drum bearing 59 includes an outer peripheral projected portion 59*b* projected toward the cleaning frame 27 and includes a plate portion 59*k*. The drum bearing 59 includes the inner peripheral portion 59*b* which penetrates through the outer peripheral projected portion 59*a* in an axial direction of the photosensitive drum 1*a*. Further, the drum bearing 59 includes a positioning hole 59*c*, provided in the plate portion 59*k*, for positioning the drum bearing 59 relative to the cleaning frame 27. Further, the drum bearing 59 includes the through-hole 59*d*, provided in the plate portion 59*k*, into which the connecting pin 37 described later is inserted.

The cleaning frame 27 includes an outer wall 27*b*, extending in a direction perpendicular to an axis of the photosensitive drum 1*a*, on one end portion side of the photosensitive drum 1*a* with respect to the axial direction of the photosensitive drum 1*a*. This outer wall 27*b* is provided with a mounting hole 27*c* for receiving the outer peripheral projected portion 29*a* in the case where the outer peripheral projected portion 29*a* of the drum bearing 29 is inserted into the mounting hole 27*c*.

Further, The cleaning frame 27 includes an outer wall 57*b*, extending in a direction perpendicular to an axis of the photosensitive drum 1*a*, on the other end portion side of the photosensitive drum 1*a* with respect to the axial direction of the photosensitive drum 1*a*. This outer wall 57*b* is provided with a mounting hole 57*c* for receiving the outer peripheral projected portion 59*a* in the case where the outer peripheral projected portion 59*a* of the drum bearing 59 is inserted into the mounting hole 57*c*.

Each of these mounting holes 27*c* and 57*c* defines a partly circular portion having an opposite distance, between ends of the partly circular portion, which is smaller than a diameter of the mounting holes 27*c* and 57*c* and is larger than the diameter of the drum flanges 41 and 42. The drum flanges 41 and 42 engage in the inner peripheral portions 29*b* and 59*b* of the drum bearings 29 and 59. Positioning pins 27*d* and 57*d* formed integrally with and provided on the outer walls 27*b* and 57*b* of the cleaning frame 27 are configured to hermetically engage in the positioning holes 29*c* and 59*c* provided in the drum bearings 29 and 59. Further, longitudinal positions of the drum bearings 29 and 59 and the cleaning frame 27 are determined by the outer walls 27*b* and 57*b*.

In the above-described manner, the photosensitive drum 1*a* assembled into a unit is mountable to the cleaning frame 27 from a direction perpendicular to the axial direction (longitudinal direction) of the photosensitive drum 1*a*. At the same time, when the drum bearings 29 and 59 are mounted to the cleaning frame 27 from the longitudinal direction, the positions of the drum bearings 29 and 59 relative to the cleaning frame 27 are determined. In order to mount the photosensitive drum 1*a* to the cleaning frame 27, the photosensitive drum 1*a* is moved in the direction perpendicular to its longitudinal direction and then the drum flanges 41 and 42 are passed through the ends of the partly circular portions and are inserted into the bearing mounting holes 27*c* and 57*c*. In this state, the drum bearings 29 and 59 are moved in the axial direction, so that the drum flanges 41 and 42 are engaged in the inner peripheral portions 29*b* and 59*b*. By further moving the drum flanges 41 and 42 in the axial direction, the outer peripheral projected portions 29*a* and 59*a* are engaged in the bearing mounting holes 27*c* and 57*c* of the cleaning frame 27 and then the drum bearings 29 and 59 are fastened with screws X and X.

Figure 4:
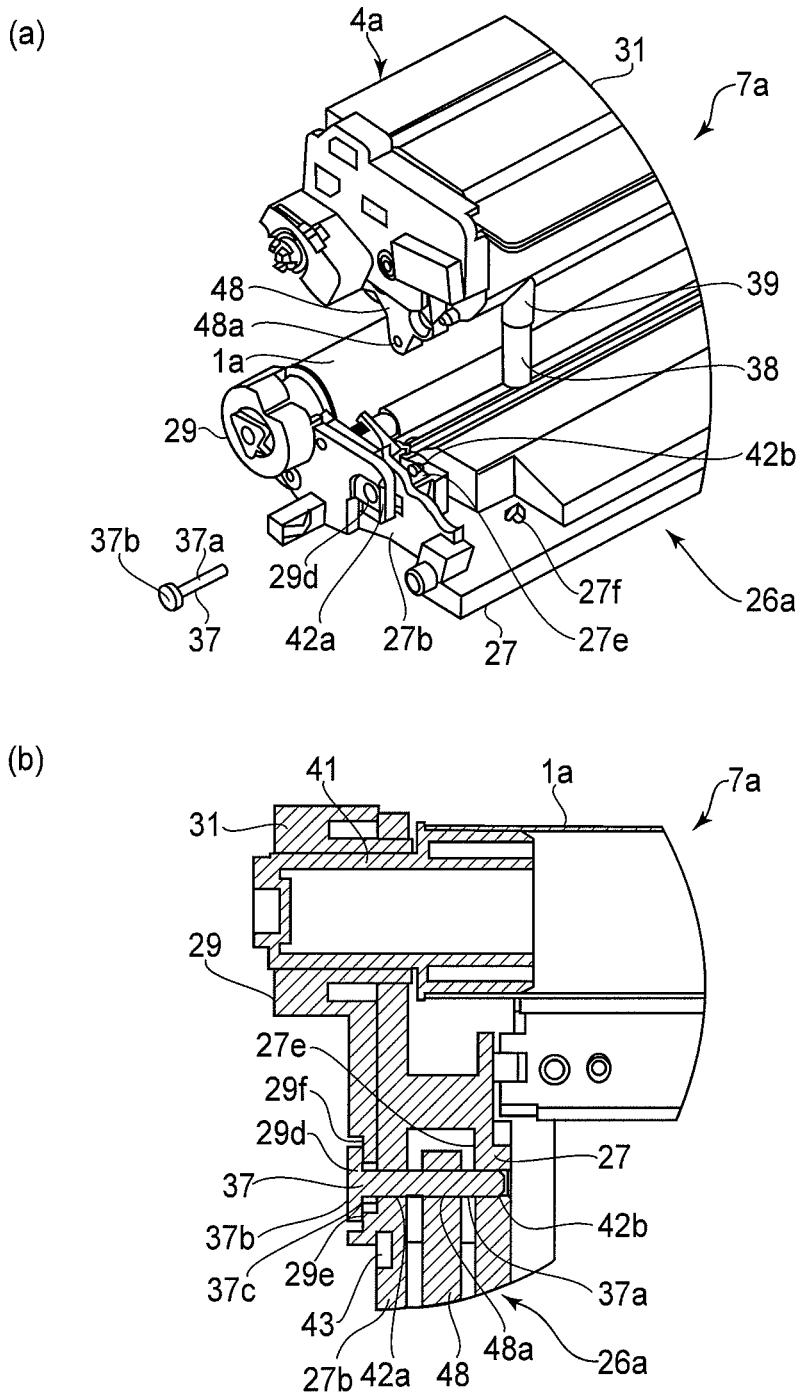
FIG. 4(*a*) is an enlarged exploded perspective view of the process cartridge in a state in which the cleaning unit and a developing unit are separated, and FIG. 4(*b*) is an enlarged sectional view of the process cartridge in a state in which the cleaning unit and the developing unit are connected.

FIG. 4(*a*) is an enlarged exploded perspective view of the process cartridge 7*a* in a state in which the cleaning unit 26*a* and the developing unit 4*a* are separated. FIG. 4(*b*) is an enlarged sectional view of the process cartridge 7*a* in a state in which the cleaning unit 26*a* and the developing unit 4*a* are connected by the connecting pin 37. Incidentally, in Embodiment 1, the connection between the cleaning unit 26*a* and the developing unit 4*a* will be described with respect to only one longitudinal side of the process cartridge 7*a* but the same connecting constitution is employed also with respect to the other longitudinal side of the process cartridge 7*a*.

The cleaning frame 27 which is a first frame includes the outer wall 27*b* which is a plate-like outside plate (first wall portion) formed on an outer end portion side with respect to the axial direction of the photosensitive drum 1*a*. Further, the cleaning frame 27 includes an inner wall 27*e* which is a plate-like side plate (third wall portion) formed on an inner end portion side with respect to the axial direction of the photosensitive drum 1*a*. The outer wall 27*b* is provided with a connecting hole 42*a* which is a second pin hole (second hole portion). The inner wall 27*e* is provided with a connecting hole 42*b* which is a third pin hole (third hole portion). The drum bearing 29 is mountable to the cleaning frame 27 by the connecting pin 37 although it will be described later. Further, the drum bearing 29 is provided with a through-hole 29*d* which is formed at a position coaxial with the connecting holes 42*a* and 42*b* provided in the cleaning frame 27 and is larger in diameter than those of the connecting holes 42*a* and 42*b*.

On the other hand, the developing unit 4*a* is provided with an arm portion (second wall portion) 48 formed on an end portion side with respect to the axial direction of the photosensitive drum 1*a* and is projected in a direction perpendicular to the axial direction of the photosensitive drum 1*a*. On an end side of the arm portion 48, a connecting hole 48*a* which is a fourth pin hole (third hole portion) is provided.

The connecting pin 37 includes a shaft portion 37*a* which is engaged in the through-hole 29*d*, the connecting hole 42*a*, the connecting hole 42*b* and the connecting hole 48*a* so as to swingably connect the cleaning frame 27 and the developing device frame 31 with each other, and includes a flange portion 37*b* provided at an end portion of the shaft portion 37*a*. Specifically, the connecting pin 37 is inserted into the through-hole 29*d* of the drum bearing 29, the connecting hole 42*a* of the outer wall 27*b*, the connecting hole 42*b* of the inner wall 27*e* and the connecting hole 38*a* of the arm portion 48. Then, the frames 27 and 31 are retained by the flange portion 37*b* having a larger diameter than those of the through-hole 29*d* and the connecting hole 37*a*. In a state in which the connecting pin 37 is inserted into the connecting holes 42*a*, 42*b* and 48*a*, these connecting holes 42*a*, 42*b* and 48*a* are swingable each other. Further, diameter dimensions of the respective connecting holes 42*a*, 42*b* and 48*a* and the shaft portion 37*a* are set so that the shaft portion 37*a* of the connecting pin 37 insures press fit (tight engagement) with respect to the connecting holes 42*a* and 42*b* of the cleaning frame 27 and so that the shaft portion 37*a* insures clearance (loose) fit with respect to the connecting hole 49*a* of the developing unit 4*a*.

In the case where the cleaning unit 4*a* and the cleaning unit 26*a* are connected by the connecting pin 37, the developing unit 4*a* and the cleaning unit 26*a* are assembled at a position in which the connecting holes 42*a*, 42*b* and 48*a* are aligned with each other in the axial direction of the photosensitive drum 1*a*.

In that state, the shaft portion 37*a* of the connecting pin 37 penetrates through the through-hole 29*d* of the drum bearing 29, the connecting holes 42*a* and 42*b* of the cleaning frame 27 and the connecting hole 48*a* of the developing unit 4*a*, so that the developing unit 4*a* and the cleaning unit 26*a* are connected (FIG. 4(*b*)). The connecting pin 37 is positioned with respect to its longitudinal direction by abutment of an abutment surface 37*c* of the flange portion 37*b* against an abutment bearing surface 29*f* of the drum bearing 29. Therefore, the connecting pin 37 is held by the cleaning unit 26*a* by sandwiching the drum bearing 29 between the flange portion 37*b* and the cleaning unit 26*a*, so that the developing unit 4*a* is rotatably supported by the cleaning unit 26*a*. Thus, the drum bearing 29 is fixable on the cleaning frame 27 by the flange portion 37*b*. Further, in a state in which the flange portion 37*b* and the outer wall 27*b* sandwiched the drum bearing 29 therebetween, the drum bearing 29 is mounted on the outer wall 27*b*.

Further, the developing unit 4*a* is provided with a projection 39 for spring, and an urging spring (compression coil spring) 38 is externally inserted into the projection 39. When the developing unit 4*a* and the cleaning unit 26*a* are connected, the urging spring 38 is configured to be positioned between the projection 39 of the developing unit 4*a* and a spring bearing surface 27*f* of the cleaning unit 26*a*. As a result, the photosensitive drum 1*a* of the cleaning unit 26*a* and the developing roller (not shown) of the developing unit 4*a* contact each other with a predetermined pressure.

Figure 5:
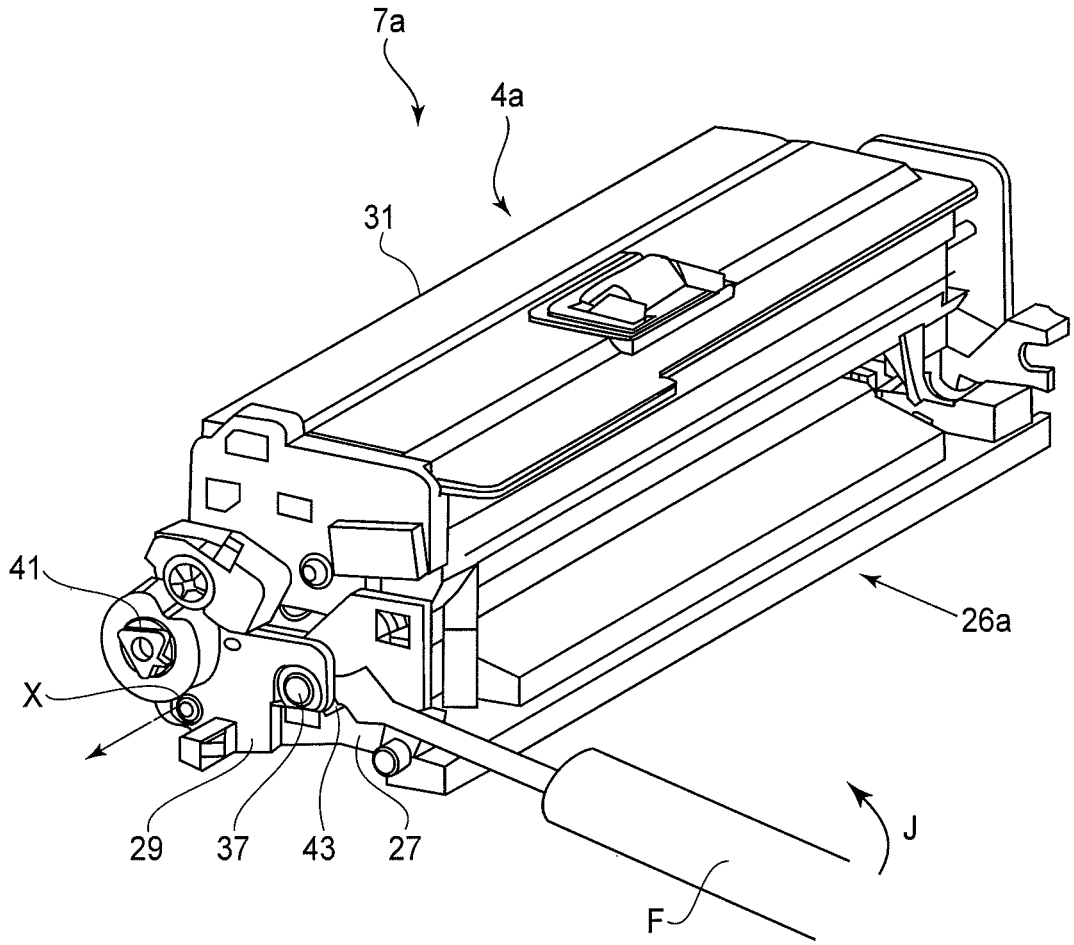
FIG. 5 is a perspective view for illustrating a disassembling method of the process cartridge.

FIG. 5 is a perspective view of the process cartridge 7*a*. A disassembling method of the process cartridge 7*a* will be specifically described below with reference to FIG. 5 in combination with FIG. 4(*b*). Particularly, the disassembling method of the process cartridge 7*a* is characterized in that when the connecting pin 37 is disengaged, the drum bearing 29 is detachable from the cleaning frame 27 and at the same time, the cleaning frame 27 is detachable from the developing device frame 31. First, the screw X which secures the drum bearing 29 and the cleaning frame 27 is disconnected. In a state in which the screw X is disconnected, the drum bearing 29 is fixed on the cleaning frame 27 by the flange portion 37*b* of the connecting pin 37. Then, a simple tool such as a screwdriver F is inserted into a recessed portion 43 provided in the neighborhood of the connecting hole 42*a* of the cleaning frame 27. When the screwdriver F is rotated in a direction indicated by an arrow J while utilizing the principle of leverage, the drum bearing 29 is detached from the cleaning frame 27. Further, when the drum bearing 29 is detached from the cleaning frame 27, the flange portion 37*b* of the connecting pin 37 receives a force from an abutment surface 29*e* of the drum bearing 29 in an opposite direction to the insertion direction. Therefore, the connecting pin 37 is disconnected integrally with the drum bearing 29 from the cleaning frame 27.

When the connecting pin 37 is disconnected, the cleaning unit 26*a* and the developing unit 4*a* are disassembled. Further, with respect to the cleaning unit 26*a*, the photosensitive drum 1*a* is dismounted by detaching the drum bearing 29 from the cleaning unit 26*a*.

As described above, according to Embodiment 1, the connecting pin 37 for connecting the cleaning unit 26*a* and the developing unit 4*a* includes the shaft portion 37*a* and the flange portion 37*b*, and the flange portion 37*b* sandwiches the drum bearing between itself and the outer wall 27*b* and the shaft portion 37*a* fixes the drum bearing 29 on the cleaning frame 27. As a result, the connecting pin 37 can be used as one of fixing means for fixing the drum bearing 29 on the cleaning frame 27, so that reduction in the number of screws can be realized. Further, during the disassembling, by dismounting the drum bearing from the cleaning frame 27, the connecting pin 37 can also be disconnected at the same time, so that a disassembling step of the cleaning unit 26*a* and the developing unit 4*a* and a disassembling step of the photosensitive drum 1*a* can be performed simultaneously. Further, according to Claim 1, the members such as the connecting pin 37 and the drum bearings 29 and 59 can be dismounted without being damaged.

In this embodiment, the constitution in which the shaft portion 37*a* of the connecting pin 37 is engaged in both of the second hole portion 42*a* and the fourth hole portion 42*b* is described but the present invention is not limited to this constitution. For example, a constitution in which the shaft portion 37*a* is not engaged in the fourth hole portion 42*b* may also be employed. In this case, the shaft portion 37*a* is configured to be engaged in the first hole portion 29*d*, the second hole portion 42*a* and the third hole portion 48*a*.

Embodiment 2

Figure 6:
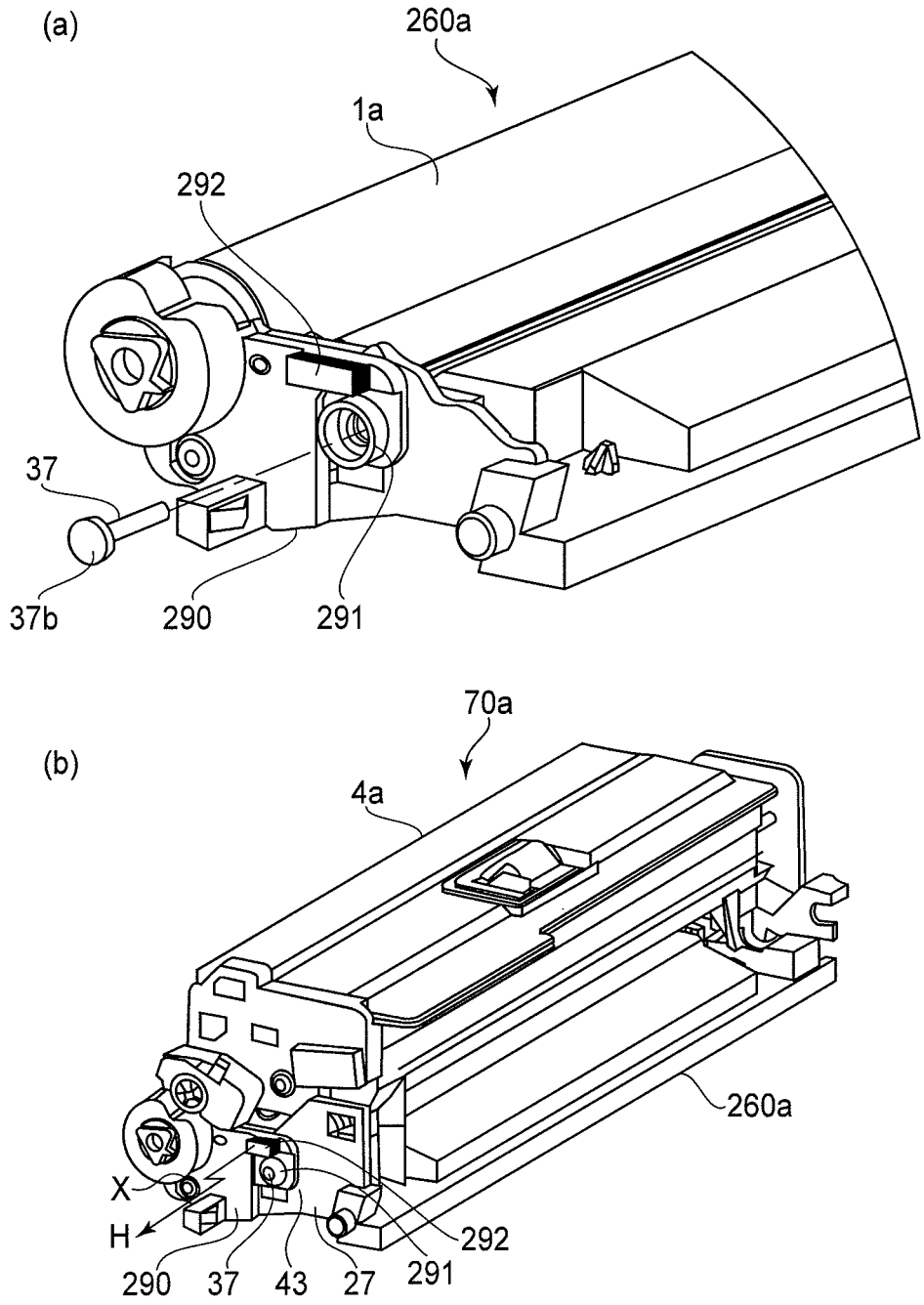
FIG. 6(*a*) is a perspective view showing a structure of a cleaning unit provided in an image forming apparatus in Embodiment 2, and FIG. 6(*b*) is a perspective view showing a structure of a process cartridge provided in the image forming apparatus in Embodiment 2.

FIG. 6(*a*) is a perspective view showing a structure of a cleaning unit 260*a* provided in an image forming apparatus in Embodiment 2. FIG. 6(*b*) is a perspective view showing a structure of a process cartridge 70*a* provided in the image forming apparatus in Embodiment 2. With respect to constitutions of the cleaning unit 260*a* and the process cartridge 70*a* in this embodiment, the same constitutions as the cleaning unit 26*a* and the process cartridge 7*a* in Embodiment 1 and their effects will be described by using the same reference numerals or symbols and will be appropriately omitted from the description. Also in Embodiment 2, the present invention is applied to the image forming apparatus similar to that in Embodiment 1, so that the image forming apparatus will be omitted from the description. A difference of the cleaning unit 260*a* and the process cartridge 70*a* in Embodiment 2 from the cleaning unit 26*a* and the process cartridge 7*a* in Embodiment 1 is that the connecting pin 37 is fixed by welding on a drum bearing 290 in the cleaning unit 260*a*.

As shown in FIG. 6(*a*), the cleaning unit 260*a* includes, in place of the drum bearing 29, the drum bearing 290 on which a welding rib 291 and a grip portion 292 are formed. Here, the welding rib 291 has a circular shape and is configured to have a diameter larger than that of the flange portion 37*b* of the connecting pin 37.

The cleaning unit 260*a* and the developing unit 4*a* are connected by the connecting pin 37 by the same method as in Embodiment 1 and thereafter the welding rib 291 provided on the drum bearing 290 is welded so as to cover the flange portion 37*b* of the connecting pin 37 with a resin (FIG. 6(*b*)). Thus, by fixing the connecting pin 37 in the drum bearing 290 by the welding, the connecting pin 37 can be prevented from being detached by an impact or the like.

Further, when the cleaning unit 260*a* and the developing unit 4*a* are disassembled, the screw X which secures the drum bearing 290 and the cleaning frame 27 is disconnected. Thereafter, the grip portion 292 of the drum bearing 290 is gripped and pulled in a direction indicated by an arrow H in FIG. 6(*b*), the drum bearing 290 can be detached from the cleaning frame 27. Further, by the drum bearing 290, the connecting pin 37 can also be disconnected from the cleaning frame 270.

By disconnecting the connecting pin 37, the cleaning unit 260*a* and the developing unit 4*a* can be disassembled. Further, with respect to the cleaning unit 260*a*, the photosensitive drum 1*a* can be dismounted by detaching the drum bearing 290. Incidentally, in this embodiment, only the cleaning unit 260*a* for yellow and the process cartridge 70*a* for yellow are described but the same constitutions can also be employed with respect to the cleaning units and developing units for magenta, cyan and black.

According to the image forming apparatuses in Embodiment 1 and Embodiment 2, when the connecting pin 37 is disconnected, the cleaning frame 27 and the developing device frame 31 are separated and at the same time, the drum bearing 29 (290) for supporting the photosensitive drum 1*a* is separated from the cleaning frame 27. As a result, the process cartridge 7*a* (70*a*) can be easily disassembled compared with the conventional process cartridge.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 281597/2009 filed Dec. 11, 2009, which is hereby incorporated by reference.

What is claimed is:

1. A process cartridge detachably mountable to a main assembly of an image forming apparatus, said process cartridge comprising:

an image bearing member on which an electrostatic image is to be formed;

a first frame;

a bearing member, detachably mountable to said first frame, for rotatably supporting said image bearing member;

a first hole provided in said bearing member;

a first wall, provided on said first frame, in which a second hole is provided;

a second frame for rotatably supporting a developer carrying member on which a developer for developing the electrostatic image is to be carried;

a second wall, provided on said second frame, in which a third hole is provided; and a connecting member including a shaft portion penetrating through said first hole, said second hole, and said third hole, and said connecting member tightly engaging in said second hole, and including a flange portion, provided at an end portion of the shaft portion, for preventing said bearing member from being detached from said first frame, wherein said second frame is rotatable about said connecting member relative to said first frame.

2. A cartridge according to claim 1, further comprising a third wall, provided on said first frame, in which a fourth hole is provided, wherein said second wall is disposed between said first wall and said third wall, and said shaft portion penetrates through said first hole, said second hole, said third hole and said forth hole and tightly engages in said second hole and said fourth hole.

3. A cartridge according to claim 1, wherein said connecting member is welded on said bearing member.

4. A cartridge according to claim 1, wherein said first wall is provided with a recessed portion at a position corresponding to an end portion of said bearing member.

5. A cartridge according to claim 1, wherein, with respect to a longitudinal direction of said image-bearing member, said flange portion, said bearing member, said first wall, and said second wall are provided in this order from an outside of said cartridge.

6. A process cartridge detachably mountable to a main assembly of an image forming apparatus, said process cartridge comprising:

an image bearing member on which an electrostatic image is to be formed;

a first frame;

a bearing member, detachably mountable to said first frame, for rotatably supporting said image bearing member;

a first wall provided on said first frame a second frame for rotatably supporting a developer carrying member on which a developer for developing the electrostatic image is to be carried;

a second wall provided on said second frame; and a connecting member including a shaft portion penetrating through said first wall and said second wall, wherein said connecting member is provided in said bearing member and is detachable from said first frame and said second frame by demounting said bearing member from said first frame.

* * * * *